US005929008A

United States Patent [19]

Goldstein

[11] Patent Number: 5,929,008

[45] Date of Patent: Jul. 27, 1999

[54] LIQUID AUTOMATIC DISHWASHING COMPOSITIONS PROVIDING HIGH PH WASH SOLUTIONS

[75] Inventor: Alan Scott Goldstein, Blue Ash, Ohio

[73] Assignee: The Procter & Gamble Company, Cincinnati, Ohio

[21] Appl. No.: 08/939,556

[22] Filed: Sep. 29, 1997

[51] Int. Cl.[6] ..... C11D 3/06; C11D 3/08; C11D 3/395; C11D 7/56

[52] U.S. Cl. ..... 510/221; 510/232; 510/372; 510/378

[58] Field of Search ..... 510/221, 232, 510/372, 378

[56] References Cited

U.S. PATENT DOCUMENTS

| | | | |
|---|---|---|---|
| 3,630,923 | 12/1971 | Simmons et al. | 252/99 |
| 3,671,440 | 6/1972 | Sabatelli et al. | 252/103 |
| 3,931,031 | 1/1976 | Willard | 252/99 |
| 3,950,276 | 4/1976 | Grand | 252/536 |
| 4,191,661 | 3/1980 | Halas et al. | 252/103 |
| 4,199,468 | 4/1980 | Barford et al. | 252/103 |
| 4,252,663 | 2/1981 | Eriksson | 252/99 |
| 4,259,199 | 3/1981 | Wee et al. | 252/99 |
| 4,268,406 | 5/1981 | O'Brien et al. | 252/105 |
| 4,501,681 | 2/1985 | Groult et al. | 252/174.12 |
| 4,591,449 | 5/1986 | Goedhart et al. | 252/99 |
| 4,740,327 | 4/1988 | Julemont et al. | 252/103 |
| 4,836,948 | 6/1989 | Corring | 252/99 |
| 5,047,167 | 9/1991 | Sten et al. | 252/160 |
| 5,053,158 | 10/1991 | Dixit et al. | 252/99 |
| 5,064,553 | 11/1991 | Dixit et al. | 252/94 |
| 5,135,675 | 8/1992 | Elliott et al. | 252/103 |
| 5,141,664 | 8/1992 | Corring et al. | 252/90 |
| 5,160,448 | 11/1992 | Corring | 252/95 |
| 5,169,552 | 12/1992 | Wise | 252/95 |
| 5,202,046 | 4/1993 | Dixit et al. | 252/94 |
| 5,205,953 | 4/1993 | Dixit | 252/94 |
| 5,209,863 | 5/1993 | Dixit et al. | 252/94 |
| 5,219,486 | 6/1993 | Ahmed et al. | 252/94 |
| 5,229,026 | 7/1993 | Dixit | 252/94 |
| 5,232,621 | 8/1993 | Dixit et al. | 252/174.23 |
| 5,246,615 | 9/1993 | Broadwell et al. | 252/135 |
| 5,252,241 | 10/1993 | Dixit et al. | 252/94 |
| 5,252,242 | 10/1993 | Shevade et al. | 252/97 |
| 5,298,180 | 3/1994 | Dixit | 252/94 |
| 5,368,766 | 11/1994 | Dixit | 252/94 |
| 5,384,061 | 1/1995 | Wise | 252/95 |
| 5,395,547 | 3/1995 | Broadwell et al. | 252/97 |
| 5,413,727 | 5/1995 | Drapier et al. | 252/97 |
| 5,427,707 | 6/1995 | Drapier et al. | 252/99 |

FOREIGN PATENT DOCUMENTS

| | | | |
|---|---|---|---|
| 0295093 | 12/1988 | European Pat. Off. | C11D 3/395 |
| 0345611 | 12/1989 | European Pat. Off. | C11D 17/00 |
| 0479370 | 4/1992 | European Pat. Off. | C11D 17/00 |
| 0517311 | 12/1992 | European Pat. Off. | C11D 3/395 |
| 0522604 | 1/1993 | European Pat. Off. | C11D 17/00 |
| 1527706 | 10/1978 | United Kingdom | C11D 7/60 |
| 2116199 | 9/1983 | United Kingdom | C11D 3/60 |
| 2203163 | 10/1988 | United Kingdom | C11D 7/56 |
| 2279963 | 1/1995 | United Kingdom | C11D 3/34 |
| 89/04362 | 5/1989 | WIPO | C11D 3/395 |

*Primary Examiner*—Yogendra Gupta
*Assistant Examiner*—John M. Petruncio
*Attorney, Agent, or Firm*—Jacobus C. Rasser; Kim W. Zerby; Pankaj M. Khosla

[57] ABSTRACT

Improved liquid automatic dishwashing detergent compositions comprising phosphate builder, a bleach, and a silicate which provides a high pH, namely about 11.5 or greater, wash solution and has a reserve alkalinity of about 6.2 or greater. The compositions of this invention are substantially free of carbonate salts.

7 Claims, No Drawings

LIQUID AUTOMATIC DISHWASHING COMPOSITIONS PROVIDING HIGH PH WASH SOLUTIONS

FIELD OF THE INVENTION

The present invention is in the field of liquid automatic dishwashing detergent compositions useful in domestic machine dishwashing, especially automatic dishwashing compositions (ADD's) substantially free of carbonate which provide a high pH wash solution.

BACKGROUND OF THE INVENTION

Automatic dishwashing is a demanding field in which specialized detergent formulations are required to deliver efficient and effective sanitization and cleansing of dishware, including stain removal and tough food cleaning. Automatic dishwashing has some unique constraints as compared to fabric laundering; for example, spotlessness and lack of film on glasses and silverware is particularly important. In many laundering operations, in contrast, there is a tolerance for substances which may be greasy, oily, soapy or lubricious, often fabric softeners or fatty acid salts, being deposited on the substrate being cleaned.

In modern automatic dishwashing formulations, tough food cleaning performance is essential. Alkalis are used as effective builders but may be highly corrosive, especially at high levels. Stain removal, for example of stains deposited by hot beverages such as tea, coffee or the like is especially sought after by the consumer. This is commonly accomplished by a variety of bleaches.

Automatic dishwashing with bleaching chemicals is different from fabric bleaching. In automatic dishwashing, use of bleaching chemicals involves promotion of soil removal from dishes, though soil bleaching may also occur. Additionally, soil antiredeposition and anti-spotting effects from bleaching chemicals are desirable. Some bleaching chemicals (such as a hydrogen peroxide source, alone or together with tetraacetylethylenediamine, a.k.a. "TAED") can, in certain circumstances, be helpful for cleaning dishware.

Various efforts have been made to improve the efficacy of liquid automatic dishwashing detergents.

It is accordingly an object herein to provide an improved automatic dishwashing detergent formulated to deliver uncompromised levels of cleaning and stain removal without undesirable spotting/filming, odor or foaming deficiencies.

BACKGROUND ART

U.S. Pat. No. 4,199,486 to Barford et al, U.S. Pat. No. 4,191,661 to Halas et al, U.S. Pat. No. 4,836,948 to Corring et al, U.S. Pat. No. 5,047,167 to Corring et al, U.S. Pat. No. 5,141,664 to Corring et al, U.S. Pat. No. 5,160,448 to Corring et al, U.S. Pat. Nos. 5,368,766, 5,368,766, 5,298,180, 5,229,026 and 5,205,953 all to Dixit, U.S. Pat. Nos. 5,064,533, 5,053,158, 5,064,553, 5,202,046, 5,209,863, 5,232,621 and 5,252,241 all to Dixit et al, U.S. Pat. No. 3,630,923 to Simmons et al, U.S. Pat. No. 3,671,440 to Sabatelli et al, U.S. Pat. No. 4,591,449 to Goedhart et al, U.S. Pat. No. 5,135,675 to Elliott et al, U.S. Pat. No. 5,169,552 to Wise, U.S. Pat. No. 5,384,061 to Wise, U.S. Pat. No. 4,501,681 to Groult et al, U.S. Pat. No. 4,740,327 to Julemont et al, U.S. Pat. No. 5,047,167, to Steyn et al, U.S. Pat. No. 5,219,486 to Ahmed et al, U.S. Pat. No. 5,252,242 to Shevade et al, U.S. Pat. Nos. 5,413,727 and 5,427,707 all to Drapier et al, U.S. Pat. Nos. 5,395,547, 5,395,547 and 5,246,615 all to Broadwell et al, GB Patent No. 2,116,199 to Colgate Palmolive, GB Patent No. 1,527,706 to Chemed, GB Patent No. 2,203,163 to Sandoz, GB Patent No. 2,279,963 to Procter & Gamble, EP Patent No. 295,093 to Unilever, EP Patent No. 345,611 to Colgate Palmolive, EP Patent Application No. 479,370 to Unilever, EP Patent Application No. 517,311 to Colgate Palmolive, EP Patent Application No. 522,604 to Colgate Palmolive and WO Patent Application No. 89/04362.

SUMMARY OF THE INVENTION

It has now unexpectedly been discovered that liquid automatic dishwashing detergent compositions are significantly improved by providing a high "in wash" pH in the absence of any carbonate. These ADD compositions exhibit improved cleaning and filming, especially, an acceptable safety profile, which is not normally associated with high pH ADD compositions.

Accordingly, it is an object of the present invention to provide a liquid automatic dishwashing composition comprising a phosphate builder, a bleach and a silicate, wherein said dishwashing composition is substantially free of carbonate and has a reserve alkalinity of about 6.2 or greater, and wherein further said dishwashing composition provides an in wash pH of about 11.5 or greater.

It is a further object of the present invention to provide these liquid automatic dishwashing detergent composition comprising phosphate builder, bleaching agent (e.g., hypochlorite; perborate), a silicate and, optionally a conventional detergent additive. Preferred methods for washing tableware are included. These and other objects, features and advantages will be apparent from the following description and the appended claims.

All parts, percentages and ratios used herein are expressed as percent weight unless otherwise specified. All documents cited are, in relevant part, incorporated herein by reference.

DETAILED DESCRIPTION OF THE INVENTION

The present invention encompasses a liquid automatic dishwashing composition comprising a phosphate builder, a bleach and a silicate, wherein said dishwashing composition is substantially free of carbonate and has a reserve alkalinity of about 6.2 or greater, and wherein further said dishwashing composition provides an in wash pH of about 11.5 or greater.

The term "substantially free of carbonate" means that there is substantially no free carbonate ions, or $CO_3^{2-}$, present in the ADD compositions. Alternatively, there is less than about 1%, preferably less than about 0.1% by weight of carbonate present in the ADD compositions. Most preferably there is about 0.0% by weight, i.e. a trivial amount possibly due to impurities, of carbonate present in the ADD compositions. That is, no carbonate is added to the ADD compositions and any carbonate present is a result of impurities or contamination. The term carbonate includes carbonate, percarbonate and hydrogen carbonate.

The ADD compositions of the present invention have a reserve alkalinity of 6.2 or greater, preferably 6.3 or greater, most preferably 6.4 or greater. "Reserve alkalinity", as used herein refers to, the ability of an ADD composition to maintain an alkali pH in the presence of acid. This is relative to the ability of an ADD composition to have sufficient alkali in reserve to deal with any added acid while maintaining pH. More specifically, it is defined as the grams of NaOH per 100 cc's, exceeding pH 9.5, in product. The reserve alkalinity for a solution is determined in the following manner.

An Orion Model 720A pH meter with a Orion Ag/AgCl sure flow Electrode model 9172BN is standardized using pH 7 and pH 10 buffers. A 1% solution of the ADD composition to be tested is prepared in distilled water. The weight of the sample is noted. The pH of the 1% solution is measured and the solution is titrated down to pH 9.5 using a solution of 0.2N HCL. The reserve alkalinity is calculated in the following fashion:

$$\text{Reserve Alkalinity} = \%\ \text{NaOH} \times \text{Specific Gravity.}$$

$$\%\ \text{NaOH} = \frac{\text{ml HCl} \times \text{Normality of HCl} \times 4^{*}}{\text{Weight of Sample Aliquot Titrated}}$$

$*$ Equivalent weight of NaOH in the % NaOH equation, derived from:

$$\%\ \text{NaOH} = \frac{\text{ml HCl} \times \text{Normality of HCl} \times \text{Equiv. Weight NaOH} \times 100}{1000 \times \text{Weight of Sample Aliquot Titrated}}$$

The in wash pH provided by the ADD compositions herein is about 11.5 or greater, preferably about 11.7 or greater.

Bleaches

More generally the bleach herein is any conventional bleach compound or mixture which under consumer use conditions provides an effective amount of a bleaching species. This bleach can be either an oxygen bleach, or a chlorine bleach. Levels may vary widely but, they are usually in the range from about 0.1% to about 90%, more typically from about 0.5% to about 70%, preferably about 1.0% to about 50%, more preferably about 1.0% to about 30% by weight of the ADD compositions herein. It is most preferred that the bleach be a chlorine bleach, as these bleaches give improved cleaning on protenacious soils.

Oxygen bleaches can be any convenient conventional oxygen bleach, including hydrogen peroxide, but as noted hereinbefore not including percarbonate. For example, perborate, e.g., sodium perborate (any hydrate but preferably the mono- or tetra-hydrate), peroxyhydrate, sodium pyrophosphate peroxyhydrate, urea peroxyhydrate, or sodium peroxide can be used herein. Organic peroxy compounds can also be used as oxygen bleaches. Examples of these are Benzoyl peroxide and the diacyl peroxides. Sodium percarbonate is not preferred as it results in the generation of $CO_3^{2-}$ which is undesirable in the present ADD compositions. Sodium perborate monohydrate is preferred. Mixtures of any convenient oxygen bleaching sources can also be used.

Chlorine bleaches can be any convenient conventional chlorine bleach. Such compounds are often divided in to two categories namely, inorganic chlorine bleaches and organic chlorine bleaches. Examples of the former are sodium hypochlorite, calcium hypochlorite, potassium hypochlorite, magnesium hypochlorite and chlorinated trisodium phosphate dodecahydrate. Examples of the latter are potassium dichloroisocyanurate, sodium dichloroisocyanurate, 1,3-dichloro-5,5-dimethlhydantoin, N-chlorosulfamide, chloramine T, Dichloramine T, chloramine B, Dichloramine T, N,N'-dichlorobenzoylene urea, paratoluene sulfondichoroamide, trichloromethylamine, N-chloroammeline, N-chlorosuccinimide, N,N'-dichloroazodicarbonamide, N-chloroacetyl urea, N,N'-dichlorobiuret and chlorinated dicyandamide. Preferably the chlorine bleach is an inorganic chlorine bleach, more preferably it is sodium hypochlorite.

Phosphate Builder

Phosphate builders will typically be included in the compositions herein to assist in controlling mineral hardness. Builders are typically used in automatic dishwashing to assist in the removal of particulate soils.

The level of builder can vary widely depending upon the end use of the composition and its desired physical form. The compositions will typically comprise at least about 0.1%, preferably from about 1% to about 90%, more preferably from about 5% to about 80%, even more preferably from about 10% to about 40% by weight, of the detergent builder. Lower or higher levels of builder, however, are not excluded.

Phosphate builders include, but are not limited to, the alkali metal, such as sodium and potassium, ammonium and alkanolammonium salts of polyphosphates (exemplified by the tripolyphosphates, pyrophosphates, and glassy polymeric metaphosphates). The various alkali metal phosphates such as the well-known sodium or potassium, tripolyphosphates, sodium or potassium pyrophosphate and sodium or potassium orthophosphate can be used.

Silicates

The present ADD compositions further comprises a silicate. Silicates herein are any silicates which are soluble to the extent that they do not adversely affect spotting/filming characteristics of the ADD composition. Typical levels are in the range from about 0.1% to about 90%, more preferably from about 1% to about 70%, even more preferably from about 3% to about 40% by weight of the composition.

Examples of silicates are sodium metasilicate and, more generally, the alkali metal silicates, particularly those having a $SiO_2$:$Na_2O$ ratio in the range 1.6:1 to 3.2:1; and layered silicates, such as the layered sodium silicates described in U.S. Pat. No. 4,664,839, issued May 12, 1987 to H. P. Rieck. Na SKS-6® is a crystalline layered silicate marketed by Hoechst (commonly abbreviated herein as "SKS-6"). Unlike zeolite builders, Na SKS-6 and other silicates useful herein do not contain aluminum. Na SKS-6 is the $\delta$-$Na_2SiO_5$ form of layered silicate and can be prepared by methods such as those described in German DE-A-3,417,649 and DE-A-3,742,043. Na SKS-6 is a preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used. Various other layered silicates from Hoechst include Na SKS-5, Na SKS-7 and Na SKS-11, as the $\alpha$-, $\beta$- and $\gamma$-forms. Other silicates may also be useful, such as for example magnesium silicate, which can serve as a crispening agent in granular formulations, as a stabilizing agent for oxygen bleaches, and as a component of suds control systems.

Silicates particularly useful in ADD composition applications include granular hydrous 2-ratio silicates such as BRITESIL® H20 from PQ Corp., and the commonly sourced BRITESIL® H24. Such silicates may be helpful for anti-corrosion effects as well as the provision of moderate alkalinity. Liquid grades of various silicates can be used. Within safe limits, sodium metasilicate alone or in combination with other silicates may be used in an ADD context to boost in wash pH to the desired level.

Conventional Detergent Additives

In the preferred embodiments, a conventional detergent additive is optionally present. These conventional detergent additives can be any additive conventionally added to ADD compositions, provided that the ADD composition remains "substantially free of carbonate". Examples of such are low-foaming nonionic surfactants (especially useful in automatic dishwashing to control spotting/filming), non-clay polymeric thickeners, material care aids (which inhibit tarnishing/resoiling of cleaned tableware), dispersant polymers (which modify and inhibit crystal growth of calcium and/or magnesium salts), chelants (which control transition metals), rheology stabilizing agent, solvent, pH buffers (to adjust pH to 11.5 or greater), and detersive enzymes (to assist with tough food cleaning, especially of starchy and proteinaceous soils) are present. Additionally bleach catalysts or conventional bleach activators such as TAED, or alternately NOBS, may be added, provided that any such bleach-modifying materials are delivered in such a manner as to be compatible with the purposes of the present invention. The present detergent compositions may, moreover, comprise one or more processing aids, fillers, perfumes, preservatives, conventional enzyme particle-making materials including enzyme cores or "nonpareils", as well as pigments, and the like. In general, materials used for the production of ADD particles herein are preferably checked for compatibility with spotting/filming on glassware. Test methods for spotting/filming are generally described in the automatic dishwashing detergent literature, including DIN test methods. Certain oily materials, especially at longer chain lengths, and insoluble materials such as clays, as well as long-chain fatty acids or soaps which form soap scum are preferably limited or excluded from the instant compositions.

Amounts of the conventional detergent additives can vary within wide ranges. However, it is preferred that the conventional detergent additives will be present in an amount from about 0.0001% to about 90%, preferably from about 0.1% to about 90%, more preferably 0.5% to about 80%, even more preferably from about 1.0% to about 70%, by weight.

Low-Foaming Nonionic Surfactant (LFNI)

Low foaming nonionic surfactants (LFNIs) are useful in ADD compositions to assist cleaning, help defoam food soil foams, especially from proteins, improve water-sheeting action (especially from glass), improve quick-drying action and help control spotting/filming. Preferably they are bleach stable. They are optionally included in the present preferably at levels of from about 0.1% to about 20%, more preferably from 0.1% to about 10%, even more preferably from about 0.25% to about 4% by weight of the composition. LFNIs are illustrated by nonionic alkoxylates, especially ethoxylates derived from primary alcohols, and blends thereof with more sophisticated surfactants, such as the polyoxypropylene/polyoxyethylene/polyoxypropylene reverse block polymers. In preferred embodiments the LFNI component is solid at about 95° F. (35° C.), more preferably solid at about 77° F. (25° C.). For ease of manufacture of granular ADD's, a preferred LFNI has a melting point between about 77° F. (25° C.) and about 140° F. (60° C.), more preferably between about 80° F. (26.6° C.) and 110° F. (43.3° C.).

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available as SLF18 from Olin Corp., and any biodegradable LFNI having the melting point properties discussed hereinabove.

pH and Buffering Variation

The present compositions comprise a combination of ingredients selected so that the composition provides an in wash pH of about 11.5 or greater. Many detergent compositions herein may be buffered, i.e., they are relatively resistant to pH drop in the presence of acidic soils. Techniques for controlling or varying pH at recommended usage levels more generally include the use of not only buffers, but also additional alkalis, acids, pH-jump systems, dual compartment containers, etc., known to those skilled in the art. Non-limiting examples of these are sodium hydroxide, potassium hydroxide, citrate, citric acid, etc. See U.S. Pat. No. 5,169,552 to Wise. Regardless of what ever is added to raise or control the pH the ADD compositions of the present invention must remain substantially free of carbonate.

Non-Clay Polymeric Thickener

The term non-clay polymeric thickener means that the thickening agent which may be used in the ADD compositions of the invention, is to be any suitable polymer. This specifically excludes the so called clay thixotropic thickeners. It is preferred that the non-clay polymeric thickener will be a cross-linked polycarboxylate polymer. The term "substantially free of carbonate" does not include polycarbonate as this does not contribute free carbonate ions to the ADD composition. For example polycarbonate builders are not excluded.

The non-clay polymeric thickener present in the composition is at a level of from about 0.1% to about 10%, preferably about 0.25% to about 5%, most preferably from about 0.5% to about 2%, by weight.

The non-clay polymeric thickener in the composition of the present invention is preferably a cross-linked polycarboxylate polymer thickening agent. This polymer preferably has a molecular weight of from about 500,000 to about 5,000,000, more preferably from about 750,000 to about 4,000,000. The carboxylate polymer is preferably a carboxyvinyl polymer. Such compounds are disclosed in U.S. Pat. No. 2,798,053, issued Jul. 2nd, 1957, to Brown, the specification of which is hereby incorporated by reference. Methods for making carboxyvinyl polymers are also disclosed in Brown.

A carboxyvinyl polymer is an interpolymer of a monomeric mixture comprising a monomeric olefinically unsaturated carboxylic acid, and from about 0.1% to about 10% by weight of the total monomers of a polyether of a polyhydric alcohol, which polyhydric alcohol contains at least four carbon atoms to which are attached at least three hydroxyl groups, the polyether containing more than one alkyenyl group per molecule. Other monoolefinic monomeric materials may be present in the monomeric mixture if desired, even in predominant proportion. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccharides, reduced derivatives thereof in which the carbonyl group is converted to an alcohol group, and pentaerythritol. It is preferred that the hydroxyl group of the modified polyol be etherified with allyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxvinyl polymers used herein include monomeric, polymerisable alpha-beta monoolefinically unsaturated lower aliphatic carboxylic acids; more preferred are monomeric monoolefinic acrylic acids of the structure

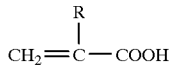

where R is a substituent selected from the group consisting of hydrogen and lower alkyl groups; most preferred is acrylic acid.

Various carboxyvinyl polymers are commercially available from B. F. Goodrich Company, New York, N.Y., under the trade name Carbopol®. Theses polymers are also known as carbomers or polyacrylic acids. Carboxyvinyl polymers useful in formulations of the present invention include Carbopol 910 having a molecular weight of about 750,000, Carbopol 941 having a molecular weight of about 1,250,000 and Carbopols 934 and 940 having molecular weights of about 3,000,000 and 4,000,000, respectively.

Preferred polycarboxylate polymers of the present invention are non-linear, water-dispersible, polyarcylate acid crosslinked with a polyalkenyl polyether and having a molecular weight of from about 750,000 to about 4,000,000.

Highly preferred examples of these polycarboxylate polymers for use in the present invention are Sokalan PHC-25®, a polyacrylic acid available from BASF Corporation, Polygel DK available from 3-V Chemical Corporation, and the Carbopol 600 series resins available from B. F. Goodrich Company, especially Carbopol 614, 616 and 617. It is believed that these are more highly crosslinked than the 900 Carbopol series polymers and have molecular weights between about 1,000,000 and 4,000,000. Mixtures of polycarboxylate polymers as herein described may also be used in the present invention.

In the preferred liquid ADD composition, the non-clay polymeric thickener provides an apparent viscosity at high shear of greater than about 500 centipoise and an apparent yield value of from about 40 to about 800, and most preferably from about 60 to about 600, dynes/cm$^2$ to the composition.

The yield value is an indication of the shear stress at which the gel strength is exceeded and flow is initiated. It is measured herein with a Brookfield RTV model viscometer with a T-bar spindle at about 77° F. (25° C.) utilizing a Helipath drive during associated readings. The system is set to 0.5 rpm and a torque reading is stopped and the rpm is reset to 1.0 rpm. A torque reading is taken for the same composition after 30 seconds or after the system is stable.

Apparent viscosities are calculated from the torque readings using factors provided with the Brookfied viscometer. An apparent or Brookfield yield value is then calculated as: Brookfield Yield Value=(apparent viscosity at 0.5 rpm−apparent viscosity at 1.0 rpm)/100. This is the common method of calculation, published in Carbopol® literature from the B. F. Goodrich Company and in other published references. In the cases of most of the formulations quoted herein this apparent yield value is approximately four times higher than yield values calculated from shear rate and stress measurements in more rigorous rheological equipment.

Apparent viscosities at high shear rate are determined with a Brookfield RVT viscometer with a spindle #6 at 100 rpm, reading the torque at 30 seconds.

Chelating Agents

The compositions herein may also optionally contain one or more transition-metal selective sequestrants, "chelants" or "chelating agents", e.g., iron and/or copper and/or manganese chelating agents. If utilized, chelating agents or transition-metal-selective sequestrants will preferably comprise from about 0.01% to about 10%, more preferably from about 0.05% to about 1% by weight of the compositions herein. Chelating agents suitable for use herein can be selected from the group consisting of aminocarboxylates, phosphonates (especially the aminophosphonates), polyfunctionally-substituted aromatic chelating agents, and mixtures thereof. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used. Without intending to be bound by theory, it is believed that the benefit of these materials is due in part to their exceptional ability to control iron, copper and manganese in washing solutions; other benefits include inorganic film prevention or scale inhibition. Commercial chelating agents for use herein include the DEQUEST® series, and chelants from Monsanto, DuPont, and Nalco, Inc. Aminocarboxylates useful as optional chelating agents are further illustrated by ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts thereof. In general, chelant mixtures may be used for a combination of functions, such as multiple transition-metal control, long-term product stabilization, and/or control of precipitated transition metal oxides and/or hydroxides.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially (but not limited to) the [S,S] isomer as described in U.S. Pat. No. 4,704,233, Nov. 3, 1987, to Hartman and Perkins. The trisodium salt is preferred though other forms, such as magnesium salts, may also be useful.

Aminophosphonates are also suitable for use as chelating agents in the compositions of the invention and include the ethylenediaminetetrakis (methylenephosphonates) and the diethylenetriaminepentakis (methylene phosphonates). Preferably, these aminophosphonates do not contain alkyl or alkenyl groups with more than about 6 carbon atoms.

Rheology Stabilizing Agent

The ADD composition of the invention may additionally contain from about 0.05% to about 5%, preferably from about 0.1% to about 2%, more preferably from about 0.2% to about 1% by weight of the ADD composition, of a rehology stabilizing agent. Such components are best characterized as any material which functions as a free radical scavenger in any aqueous composition containing a chlorine bleach ingredient.

Rehology stabilizing agents useful herein include benzoic acids described in U.S. Pat. No. 5,169,552(Wise). Also included are the sulfo benzenes described in U.S. Pat. No. 5,384,061 (Wise). All of these above references are incorporated herein by reference.

In the ADD compositions of the present invention Sodium Benzoate is the preferred rehology stabilizing agent.

Crosslinked polymers, especially those of high molecular weight, as may be present in the present-bleach containing ADD composition are vulnerable to bleach-initiated degradation and result in a loss of rehology that can be unacceptable for most applications. A certain small percentage of the chlorine bleach ingredient is present in solution in the form of a free radical, i.e., a molecular fragment having one or more unpaired electrons. These radicals, although short lived , are highly reactive and may initiate the degradation of certain other species, including any crosslinked polycarboxylate polymer present in the ADD composition, via propagation mechanism. The polymers of this invention are susceptible to this degradation because of the presumed oxidizable sites present in the cross-linking structure.

A small addition of a rheology stabilizing agent substantially increases the physically stability, i.e., rehological stability, of the ADD compositions of the present invention. Also provided is chemical stability of the chlorine bleach ingredient present in the ADD composition of the present invention. Without wishing to be bound by theory, it is believed that the rhelogy stabilizing agent functions as a free radical scavenger, tying up the highly reactive species in the composition and preventing them from attacking the degradation-susceptible structure of the polycarboxylate polymers. Agents which stabilize the rhelogy of a composition by more rapidly consuming or reacting with the free chlorine bleach are not functioning according to the invention herein.

Solvent

Liquid cleaning compositions may further comprise water and/or other solvents. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from about 1% to about 99.7%, preferably from about 5% to about 90%, and most typically from about 10% to about 50% of solvents.

Detersive Enzymes

"Detersive enzyme", as used herein, means any enzyme having a cleaning, stain removing or otherwise beneficial effect in an ADD composition. Preferred detersive enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

The ADD compositions of the present invention may comprise one or more detersive enzymes. If only one enzyme is used, it is preferably an amylolytic or a proteolytic enzyme. Highly preferred is a mixture of proteolytic enzymes and amylolytic enzymes.

More generally, the enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases.

Enzymes are normally incorporated in the instant detergent compositions at levels sufficient to provide a "cleaning-effective amount". The term "cleaning-effective amount"

refers to any amount capable of producing a cleaning, stain removal or soil removal effect on substrates such as dishware and the like. Since enzymes are catalytic materials, such amounts may be very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.0001% to about 10%, preferably 0.01%–1% by weight of a commercial enzyme preparation. Protease enzymes are usually present in such commercial preparations at levels sufficient to provide from 0.005 to 0.1 Anson units (AU) of activity per gram of composition. For automatic dishwashing purposes, it may be desirable to increase the active enzyme content of the commercial preparations, in order to minimize the total amount of non-catalytically active materials delivered and thereby improve spotting/filming results.

Suitable examples of proteases are the subtilisins which are obtained from particular strains of *B. subtilis* and *B. licheniformis*. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the trade names ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985), Protease B (see European Patent Application Serial No. 87303761.8, filed Apr. 28, 1987, and European Patent Application 130,756, Bott et al, published Jan. 9, 1985) and Protease C (see U.S. Pat. Nos. 5,185,250 and 5,204,015).

Other preferred protease enzymes include protease enzymes which are a carbonyl hydrolase variant having an amino acid sequence not found in nature, which is derived by replacement of a plurality of amino acid residues of a precursor carbonyl hydrolase with different amino acids, wherein said plurality of amino acid residues replaced in the precursor enzyme correspond to position +210 in combination with one or more of the following residues: +33, +62, +67, +76, +100, +101, +103, +104, +107, +128, +129, +130, +132, +135, +156, +158, +164, +166, +167, +170, +209, +215, +217, +218 and +222, where the numbered positions correspond to naturally-occurring subtilisin from *Bacillus amyloliquefaciens* or to equivalent amino acid residues in other carbonyl hydrolases or subtilisins (such as *Bacillus lentus* subtilisin). Preferred enzymes according include those having position changes +210, +76, +103, +104, +156, and +166.

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh, et al, "Bleaching Compositions Comprising Protease Enzymes" having U.S. Ser. No. 08/322,677, both filed Oct. 13, 1994.

Amylases suitable herein include, for example, α-amylases described in British Patent Specification No. 1,296,839 (Novo), RAPIDASE®, International Bio-Synthetics, Inc. and TERMAMYL®, Novo Industries.

Engineering of enzymes (e.g., stability-enhanced amylase) for improved stability, e.g., oxidative stability is known. See, for example J. Biological Chem., Vol. 260, No. 11, June 1985, p.p. 6518–6521. "Reference amylase" refers to a conventional amylase inside the scope amylases useful in this invention. Further, stability-enhanced amylases, also useful herein, are typically superior to these "reference amylases".

The present invention, in certain preferred embodiments, can makes use of amylases having improved stability in detergents, especially improved oxidative stability. A convenient absolute stability reference-point against which amylases used in these preferred embodiments of the instant invention represent a measurable improvement is the stability of TERMAMYL® in commercial use in 1993 and available from Novo Nordisk A/S. This TERMAMYL® amylase is a "reference amylase", and is itself well-suited for use in the ADD (Automatic Dishwashing Detergent) compositions of the invention, as well as in inventive fabric laundering compositions herein. Preferred amylases herein can demonstrate further improvement versus more challenging reference amylases, the latter reference amylases being illustrated by any of the precursor amylases of which preferred amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

Preferred amylases herein have the commonality of being derived using site-directed mutagenesis from one or more of the Baccillus amylases, especially the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;*

(b) Stability-enhanced amylases as described by Genencor International in a paper entitled "Oxidatively Resistant alpha-Amylases" presented at the 207th American Chemical Society National Meeting, Mar. 13–17, 1994, by C. Mitchinson. Therein it was noted that bleaches in automatic dishwashing detergents inactivate alpha-amylases but that improved oxidative stability amylases have been made by Genencor from *B. lichenifor-*

*mis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE® and SUNLIGHT®;

(c) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

Cellulases usable in, but not preferred, for the present invention include both bacterial or fungal cellulases. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (*Dolabella auricula solander*). Suitable cellulases are also disclosed in GB-A-2.075.028; GB-A-2.095.275 and DE-OS-2.247.832. CAREZYME® (Novo) is especially useful.

Suitable lipase enzymes for detergent use include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli.* The LIPOLASE® enzyme derived from *Humicola lanuginosa* and commercially available from Novo (see also EPO 341,947) is a preferred lipase for use herein. Another preferred lipase enzyme is the D96L variant of the native *Humicola lanuginosa* lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Bleach Catalysts

The present invention compositions and methods can optionally contain metal-containing bleach catalysts that are effective for use in ADD compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of theses catalysts include $Mn^{IV}{}_2(u\text{-}O)_3$(1,4,7-trimethyl-1,4,7-triazacyclononane)$_2$-$(PF_6)_2$ ("MnTACN"), $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$(1,4,7-trimethyl-1,4,7-triazacyclononane)$_2$-$(ClO_4)_3$, and mixtures thereof. See also European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

The bleach catalysts useful in automatic dishwashing compositions and concentrated powder detergent compositions may also be selected as appropriate for the present invention. For examples of suitable bleach catalysts see U.S. Pat. No. 4,246,612 and U.S. Pat. No. 5,227,084.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt catalysts which have the formula:

$$[Co(NH_3)_n(M')_m]\,Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]\ Y_y$, and especially $[Co(NH_3)_5Cl]Cl_2$.

More preferred are the present invention compositions which utilize cobalt (III) bleach catalysts having the formula:

$$[CO(NH_3)_n(M)_m(B)_b]\ T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}\ s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, $F^-$, $SO_4^{-2}$, $NCS^-$, $SCN^-$, $S_2O^{-2}$, $NH_3$, $PO_4^{3-}$, and carboxylates (which preferably are monocarboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, $HOC(O)CH_2C(O)O$—, etc.) Preferred M moieties are substituted and unsubstituted $C_1$–$C_{30}$ carboxylic acids having the formulas:

$$RC(O)O—$$

wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'^{+}_4$, —C(O)OR', —OR', —$C(O)NR'_2$, wherein R' is selected from the group consisting of hydrogen and $C_1$–$C_6$ moieties. Such substituted R therefore include the moieties —$(CH_2)_nOH$ and —$(CH_2)_nNR'^{+}_4$, wherein n is an integer from 1 to about 16, preferably from about 2 to about 10, and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.,* (1983), 2, pages 1–94. For example, Table 1 at page 17, provides the base hydrolysis rates (designated therein as $k_{OH}$) for cobalt pentaamine catalysts complexed with oxalate ($k_{oH}$=2.5×$10^{-4}$ $M^{-1}\ s^{-1}$ (25° C.)), $NCS^-$ ($k_{OH}$=5.0×$10^{-4}$ $M^{-1}\ s^{-1}$ (25° C.)), formate ($k_{OH}$=5.8×$10^{-4}$ $M^{-1}\ s^{-1}$ (25° C.)), and acetate ($k_{OH}$=9.6×$10^{-4}$ $M^{-1}\ s^{-1}$ (25° C.)). The most preferred cobalt catalyst useful herein are cobalt pentaamine acetate salts having the formula $[Co(NH_3)_5OAc]\ T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$.

Cobalt catalysts according to the present invention made be produced according to the synthetic routes disclosed in U.S. Pat. Nos. 5,559,261, 5,581,005, and 5,597,936, the disclosures of which are herein incorporated by reference.

These catalysts may be coprocessed with adjunct materials so as to reduce the color impact if desired for the aesthetics of the product, or to be included in enzyme-containing particles or the compositions may be manufactured to contain catalyst "speckles".

As a practical matter, and not by way of limitation, the cleaning compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic dishwashing process, typical automatic dishwashing compositions herein will comprise from about 0.0005% to about 0.2%, more preferably from about 0.004% to about 0.08%, of bleach catalyst by weight of the cleaning compositions.

Conventional Bleach Activators

"Conventional Bleach Activators" herein are any bleach activators and are optional materials for the inventive compositions. Suitable levels are from about 0.1% to about 70%, preferably from about 0.1% to about 40% more preferably from about 0.1% to about 20%, even more preferably from 0.1% to about 8% by weight. Such activators are any known activators and are typified by TAED (tetraacetylethylenediamine). Numerous conventional activators are known. See for example activators referenced hereinabove in the background as well as U.S. Pat. No.

4,915,854, issued Apr. 10, 1990 to Mao et al, and U.S. Pat. No. 4,412,934. Nonanoyloxybenzene sulfonate (NOBS) or acyl lactam activators may be used, and mixtures thereof with TAED can also be used. See also U.S. Pat. No. 4,634,551 for other typical conventional bleach activators. Also known are amido-derived bleach activators of the formulae: $R^1N(R^5)C(O)R^2C(O)L$ or $R^1C(O)N(R^5)R^2C(O)L$ wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. Further illustration of bleach activators of the above formulae include (6-octanamido-caproyl)oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551. Another class of bleach activators comprises the benzoxazin-type activators disclosed by Hodge et al in U.S. Pat. No. 4,966,723, issued Oct. 30, 1990. Still another class of bleach activators includes acyl lactam activators such as octanoyl caprolactam, 3,5,5-trimethylhexanoyl caprolactam, nonanoyl caprolactam, decanoyl caprolactam, undecenoyl caprolactam, octanoyl valerolactam, decanoyl valerolactam, undecenoyl valerolactam, nonanoyl valerolactam, 3,5,5-trimethylhexanoyl valerolactam, t-butylbenzoylcaprolactam, t-butylbenzoylvalerolactam and mixtures thereof. The present compositions can optionally comprise aryl benzoates, such as phenyl benzoate. When such an activator is added to the instant compositions, it is preferably of a low-foaming and non-depositing type.

Material Care Agents

The present compositions may contain as corrosion inhibitors and/or anti-tarnish aids one or more material care agents other than the hereinbefore referenced silicates. Material Care Agents are preferred especially in countries where electroplated nickel silver and sterling silver are common in domestic flatware, or when aluminium protection is a concern and the composition is low in silicate. Material care agents include bismuth salts, transition metal salts such as those of manganese, certain types of paraffin, triazoles, pyrazoles, thiols, mercaptans, aluminium fatty acid salts, and mixtures thereof and are preferably incorporated at low levels, e.g., from about 0.01% to about 5% of the ADD composition. A preferred paraffin oil is a predominantly branched aliphatic hydrocarbon comprising from about 20 to about 50, more preferably from about 25 to about 45, carbon atoms with a ratio of cyclic to noncyclic hydrocarbons of about 32 to 68 sold by Wintershall, Salzbergen, Germany as WINOG 70®. $Bi(NO_3)_3$ may be added. Other corrosion inhibitors are illustrated by benzotriazole, thiols including thionaphtol and thioanthranol, and finely divided Aluminium fatty acid salts. All such materials will generally be used judiciously so as to avoid producing spots or films on glassware or compromising the bleaching action of the compositions. For this reason, it may be preferred to formulate without mercaptan anti-tarnishes which are quite strongly bleach-reactive or common fatty carboxylic acids which precipitate with calcium.

Dispersant Polymer

Preferred ADD compositions herein may additionally contain a dispersant polymer. The equivalent term "polymeric dispersant" sometimes being used. When present, a dispersant polymer in the instant ADD compositions is typically at levels in the range from 0 to about 25%, preferably from about 0.5% to about 20%, more preferably from about 1% to about 8% by weight of the ADD composition. Dispersant polymers are useful for improved filming performance of the present ADD compositions. Particularly preferred are polymers which inhibit the deposition of calcium carbonate or magnesium silicate on dishware.

Dispersant polymers suitable for use herein are further illustrated by the film-forming polymers described in U.S. Pat. No. 4,379,080 (Murphy), issued Apr. 5, 1983.

Suitable polymers are preferably at least partially neutralized salts of polycarboxylic acids. The alkali metal, especially sodium salts are most preferred. While the molecular weight of the polymer can vary over a wide range, it is typically in the range from about 1,000 to about 500,000, more preferably is from about 1,000 to about 250,000. More preferably, especially if the ADD composition is for use in North American automatic dishwashing appliances, suitable dispersant polymers have an average molecular weight of from about 1,000 to about 5,000.

Other suitable dispersant polymers include those disclosed in U.S. Pat. No. 3,308,067 issued Mar. 7, 1967, to Diehl. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable but preferably such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer are suitable for use herein. Preferably, such dispersant polymer has a molecular weight of from about 4,000 to about 20,000 and an acrylamide content of from about 0% to about 15%, by weight of the polymer.

Another preferred group of dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: $—[(C(R^2)C(R^1)(C(O)OR^3)]$ wherein the apparently unfilled valencies are in fact occupied by hydrogen and at least one of the substituents $R^1$, $R^2$, or $R^3$, preferably $R^1$ or $R^2$, is a 1 carbon to about a 4 carbon alkyl or hydroxyalkyl group; $R^1$ or $R^2$ may be hydrogen and $R^3$ may be hydrogen or alkali metal salt. Most preferred is a substituted acrylic monomer wherein $R^1$ is methyl, $R^2$ is hydrogen, and $R^3$ is sodium.

Suitable low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of about 3,500 and is the fully neutralized sodium salt form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535.

Other dispersant polymers useful herein include the polyethylene glycols and polypropylene glycols having a molecular weight of from about 950 to about 30,000 which can be obtained from the Dow Chemical Company of Midland, Mich. Such polymers for example, having a melting point within the range of from about 30° C. to about 100° C., can be obtained at molecular weights of 1,450, 3,400, 4,500, 6,000, 7,400, 9,500, and 20,000 and are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula:

$$HO(CH_2CH_2O)_m(CH_2CH(CH_3)O)_n(CH(CH_3)CH_2O)_oOH$$

wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other acceptable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDonald, issued Feb. 27, 1979. Preferred cellulose-derived dispersant polymers are the carboxymethyl celluloses.

Yet another group of acceptable dispersants are the organic dispersant polymers, such as polyaspartate although any potentially bleach-reactive polymer or other ingredient is not preferred for use herein.

Suds Suppressors

The ADD compositions of the invention can optionally contain a suds suppressor. Levels in general are from 0% to about 10%, preferably, from about 0.001% to about 5%. Typical levels tend to be low, e.g., from about 0.01% to about 3% when a silicone suds suppressor is used. Silicone suds suppressor technology and other defoaming agents useful herein are more extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Phosphate esters, either alkyl phosphoric acid esters or alkyl acid phosphate esters which can be optionally alkoxylated, have also been asserted to provide some protection of silver and silver-plated utensil surfaces in addition to suds suppression; however, the instant compositions can have excellent silvercare without a phosphate ester component. If it is desired nonetheless to use a phosphate ester, suitable compounds are disclosed in U.S. Pat. No. 3,314,891, issued Apr. 18, 1967, to Schmolka et al, incorporated herein by reference. See also U.S. Pat. No. 5,384,061, to Wise. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof. Commercially phosphate suds surpressors are SAP from Hooker and LPKN-158 from Knapsack.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Surfactant

In addition, or instead of, the LFNI surfactants described hereinbefore, the ADD compositions herein may optionally include a surfactant such as anionic detersive surfactants, typically at levels of from about 0.1% to about 5% by weight of the composition although higher levels are possible. Certain anionic surfactants, particularly precipitatable fatty carboxylic acids and high-foaming types, are preferably avoided. If used, surfactants are typically of a type having good solubility in the presence of calcium, and more preferably, exhibit a limesoap dispersing action. Such anionic surfactants are further illustrated by sulfobetaines, alkyl(polyethoxy)sulfates (AES), alkyl (polyethoxy) carboxylates, and $C_6$–$C_{10}$ alkyl sulfates. These surfactants when used will also be preferably, bleach stable. Other suitable surfactants are the amine oxides, phosphine oxides, sulfoxide or betaine water dispersible surfactants. Examples of these are the linear or branched alkali metal mono- and /or di-($C_8$–$C_{14}$) alkyl diphenyl oxide mono- and/or di-sulfates. See U.S. Pat. No. 5,395,547 to Broadwell et al.

Other Ingredients

Detersive ingredients or adjuncts optionally included in the instant compositions can include one or more materials for assisting or enhancing cleaning performance, treatment of the substrate to be cleaned, or designed to improve the aesthetics or ease of manufacture of the compositions. The fully-formulated product is desirably tested to ensure acceptable levels of spotting/filming and good foam control. Other adjuncts which can also be included in compositions of the invention at their conventional art-established levels, generally from 0% to about 20% of the composition, preferably at from about 0.1% to about 10%, include color speckles, dyes, fillers, germicides, alkalinity sources, hydrotropes, stabilizers, perfumes, preservatives, solubilizing agents, carriers, processing aids, and, solvents.

The ADD compositions of the present invention are manufactured according to conventional means well known in the art. For example see U.S. Pat. No. 5,169,552 to Wise.

Spotting/Filming and Foam Control

Preferred compositions have spotting and filming grades of 3 or less, preferably less than 2, and most preferably less than 1, as measured by the standard test of The American Society for Testing and Materials ("ASTM") D3556-85 (Reapproved 1989) "Standard Test Method for Deposition on Glassware During Mechanical Dishwashing".

Preferred compositions moreover produce less than 2 inches, more preferably less than 1 inch, of suds in the bottom of a domestic spray-arm type automatic dishwasher during normal use conditions (as determined using known methods such as, for example, that described in U.S. Pat. No. 5,294,365, to Welch et al., issued Mar. 15, 1994). Foam control can also desirably be measured by counting spray-arm rotation: preferred compositions have minimal impact on arm rotation.

EXAMPLE 1

The following liquid-gel automatic dishwashing detergent compositions are prepared by mixing:

| INGREDIENTS | A wt % | B wt % |
|---|---|---|
| Sodium tripolyphosphate (STPP) | 7.28 | 6.51 |
| Potassium tripolyphosphate (KTPP) | 16.51 | 17.52 |
| Sodium Silicate, 2.4 ratio | 3.27 | 2.5 |
| Available chlorine (added as sodium hypochlorite) | 0.93 | 1.0 |
| Polyacrylic acid (Sokalan PHC-25) | 1.26 | 1.30 |
| Benzoic acid (Rehelogy stabilizer) | 0 | 0.50 |
| p-Toluene sulfonic acid (Rehelogy stabilizer) | 0.73 | 0 |
| Potassium hydroxide (sufficient to give pH of 12.3) | Q.S. | Q.S. |
| Perfume, dye and water | Balance to 100% | Balance to 100% |

Reserve alkalinity of ADD composition A is about 6.4
Reserve alkalinity of ADD composition B is about 6.2

EXAMPLE 2

The following liquid-gel automatic dishwashing detergent compositions are prepared by mixing:

| INGREDIENTS | wt % |
|---|---|
| TETRONIC ® (LFNI nonionic) | 0.8 |
| LPKN 158 | 0.158 |
| NaOH (38%) | 4.5 |
| KTPP (60%) | 33.92 |
| STPP (3% H2O) | 5.26 |
| Sodium Silicate (47.5%) | 20.83 |
| Non-clay polymeric thickener[1] | 1.0 |
| NaOCl (13%) | 8.995 |
| water, perfume, dye, minors - Balance to: | 100 |
| pH of solution in wash | 11.5 |

Note 1: Ether Polygel Dk sold by 3V or Carbopol 614 sold by B. F. Goodrich Company.
Reserve Alkalinity of the above ADD composition is about 6.5.

EXAMPLE 3

The following liquid-gel automatic dishwashing detergent compositions are prepared by mixing:

| INGREDIENTS | wt % |
|---|---|
| Sodium tripolyphosphate | 17.5 |
| Sodium hypochlorite | 1.15 |
| Sodium silicate 3.2 ratio | 6.1 |
| Potassium hydroxide[1] | 3.5 |
| Sodium hydroxide[1] | 1.9 |
| Non-clay polymeric thickener[2] | 1.0 |
| Sodium Benzoate | 0.75 |
| water, minors(e.g. perfume, dye etc.) | Balance to 100% |

Note 1: Additional KOH and/or NaOH is added to raise the ADD composition pH to 11.7
Note 2: Either Polygel Dk ® sold by 3V or Carbopol 614 ® sold by B. F. Goodrich Company.
Reserve Alkalinity of the above ADD composition is about 6.4.

The above examples are of course illustrative, and are not intended to be limiting of the invention. The invention provides numerous advantages to the consumer, such as excellent removal of tea stains, starchy soil removal, excellent spotlessness and lack of film on both glasses and dishware, excellent silvercare, and economy.

The ADD compositions of the above examples are used to wash tea-stained cups, starch-soiled and spaghetti-soiled dishes, milk-soiled glasses, starch, cheese, egg or babyfood-soiled flatware, and tomato-stained plastic spatulas by loading the soiled dishes in a domestic automatic dishwashing appliance and washing using either cold fill, 60° C. peak, or uniformly 45–50° C. wash cycles with a product concentration of the exemplary compositions of from about 1,000 to about 5,000 ppm, with excellent results.

What is claimed is:

1. A liquid automatic dishwashing composition comprising a phosphate builder, an alkali metal perborate bleach and a silicate, wherein said dishwashing composition is free of carbonate and has a reserve alkalinity of 6.2 or greater, and wherein further said dishwashing composition provides an in wash pH of about 11.5 or greater.

2. An automatic dishwashing composition according to claim 1, wherein the in wash pH of said automatic dishwashing composition is about 11.7 or greater.

3. An automatic dishwashing composition according to claim 1, wherein said phosphate builder is present in an amount of from about 0.1% to 90% by weight, said bleach is present in an amount of from about 0.1% to about 90% by weight and said silicate is present in an amount of from about 0.1% to about 90% by weight.

4. An automatic dishwashing composition according to claim 1, wherein said automatic dishwashing composition additionally comprises a conventional detergent additive selected from low foaming nonionic surfactant, pH buffer, non-clay polymeric thickener, chelating agents, detersive enzyme, bleach catalysts, bleach activators, material care aids, solvent, rheology stabilizing agent, suds suppressor and mixtures thereof.

5. An automatic dishwashing composition according to claim 4, wherein said non-clay polymeric thickener is a cross-linked polycarboxylate polymer.

6. An automatic dishwashing composition according to claim 5 wherein said non-clay polymeric thickener is a crosslinked polyacrylate polymer.

7. A method for washing tableware, said method comprising contacting tableware in need of cleaning with an aqueous solution comprising an effective amount of a composition according to claim 1.

* * * * *